US005297013A

United States Patent [19]

Hall et al.

[11] Patent Number: 5,297,013

[45] Date of Patent: Mar. 22, 1994

[54] OUTDOOR LIGHT FIXTURE

[75] Inventors: Milly S. Hall, Dallas, Tex.; Donald L. Rohrs, Overland Park, Kans.; Jung C. Hung, Richmond, Canada

[73] Assignee: Brinkmann Corporation, Dallas, Tex.

[21] Appl. No.: 742,916

[22] Filed: Aug. 9, 1991

[51] Int. Cl.[5] ..... F21V 3/00

[52] U.S. Cl. ..... 362/363; 362/249; 362/340; 362/359; 362/431

[58] Field of Search ..... 362/153.1, 238, 249, 362/353, 354, 360, 361, 363, 294, 311, 359, 340, 431

[56] References Cited

U.S. PATENT DOCUMENTS

| | | | |
|---|---|---|---|
| 3,366,785 | 1/1968 | Huber | 240/3 |
| 4,041,305 | 8/1977 | Dean | 240/92 |
| 4,438,484 | 3/1984 | Winden | 362/363 X |
| 4,638,411 | 1/1987 | Trainor | 362/363 X |
| 4,814,961 | 3/1989 | O'Brien et al. | 362/354 X |
| 4,839,782 | 6/1989 | Sikora | 362/363 |
| 4,969,074 | 11/1990 | Davis et al. | 362/363 X |
| 4,996,636 | 2/1991 | Lovett | 362/431 |

*Primary Examiner*—Stephen F. Husar

*Attorney, Agent, or Firm*—Mitchell P. Brook; Philip Y. Dahl

[57] ABSTRACT

An outdoor light fixture that has a cover with a clear pane and an inner refracting lens adapted to refract light emitted from a light source and to fit over the light source.

13 Claims, 4 Drawing Sheets

OUTDOOR LIGHT FIXTURE

BACKGROUND OF THE INVENTION

The present invention relates to light fixtures and more particularly to refracting lenses for outdoor light fixtures.

As disclosed in co-pending, commonly-assigned U.S. patent application Ser. No. 07/742,917 and U.S. design patent applications Ser. Nos. 07/696,521, 07/696,528, 07/696,530 and 07/696,531, all filed May 7, 1991, outdoor light fixtures are widely known. Such fixtures typically are used to illuminate gardens, outdoor walkways, driveways, patios and other areas or to floodlight sculptures, trees, structures and other objects. Typically, low voltage outdoor light fixtures are constructed of metal or plastic, and have a power source, a stake for being inserted into the ground and for supporting the other parts of the light fixture, a light bulb, and a globe assembly that protects the light bulb, diffuses light emitted from the light bulb and provides decoration. In some fixtures, solar panels are used to generate power for the light bulb. In other fixtures, a low voltage power supply provides typically about 12 volts AC through a wire that runs, e.g., underground, from the low voltage power supply to the light fixtures.

In known outdoor light fixtures, the globe assembly generally serves a number of purposes, including: mounting the light bulb, conductively connecting the light bulb to a wire, protecting the light bulb, shielding the light bulb and associated electrical elements from dust and other contaminants, diffusing or redirecting the light emitted from the light bulb, and providing a decorative appearance.

It is desirable to diffuse or redirect the light to avoid large glaring hot spots. It is known to diffuse light by frosting lens portions of the globe assembly or by incorporating a translucent pigment. It is also known to refract light by incorporating ribs in the lens of the globe assembly. Such ribbed or frosted lenses are disclosed, for example, in U.S. Pat. Nos. 4,774,648 and 4,814,961.

Known globe assemblies incorporating translucent pigments, frosted surfaces or ribs possess a number of known disadvantages. One such disadvantage is diminished light output. Diminished light output occurs in frosted and translucent lenses and commonly is seen in commercial globe assemblies incorporating ribbed lenses.

A further disadvantage is that incorporating the refracting lens in the globe assembly decreases design flexibility. Often clear or unpatterned globe assemblies are preferable for aesthetic as well as functional reasons, such as efficient light transmission and staying cleaner in dusty outdoor conditions.

Yet another disadvantage is that the globe assembly must be removed in order to view the elements of the light fixture that are inside the globe to aid in installation and maintenance.

SUMMARY OF THE INVENTION

The present invention alleviates to a great extent the disadvantages of previously known light fixtures by providing a light fixture that comprises a globe assembly that has a clear pane and an inner refracting lens hat fits over a light bulb. In a preferred embodiment, the light fixture also comprises a stake for mounting the light fixture in the ground, a light bulb, apparatus for mounting the light bulb, apparatus for connecting the fixture to a power source such as a conductive wire, and apparatus for mounting the globe and inner refracting lens.

An advantage of the present invention is that the refracting lens is separate from the globe assembly, thereby providing greater design flexibility in that the lens incorporated in the globe assembly may be completely clear, or may incorporate various design features such as patterned, ribbed or frosted panes or portions of panes.

A further advantage of the present invention is that the proportion of light transmitted is increased in embodiments having a clear or partially clear globe assembly.

Yet another advantage of the present invention is that at least a portion of the globe assembly is clear, thereby aiding in installation and maintenance by providing a view of the interior of the elements of the fixture.

It is therefore an objective of the present invention to provide a light fixture that refracts light in a pleasing fashion using an inner refracting lens and a globe assembly that has a clear pane.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout and in which.

DETAILED DESCRIPTION OF THE INVENTION

Figure 1:
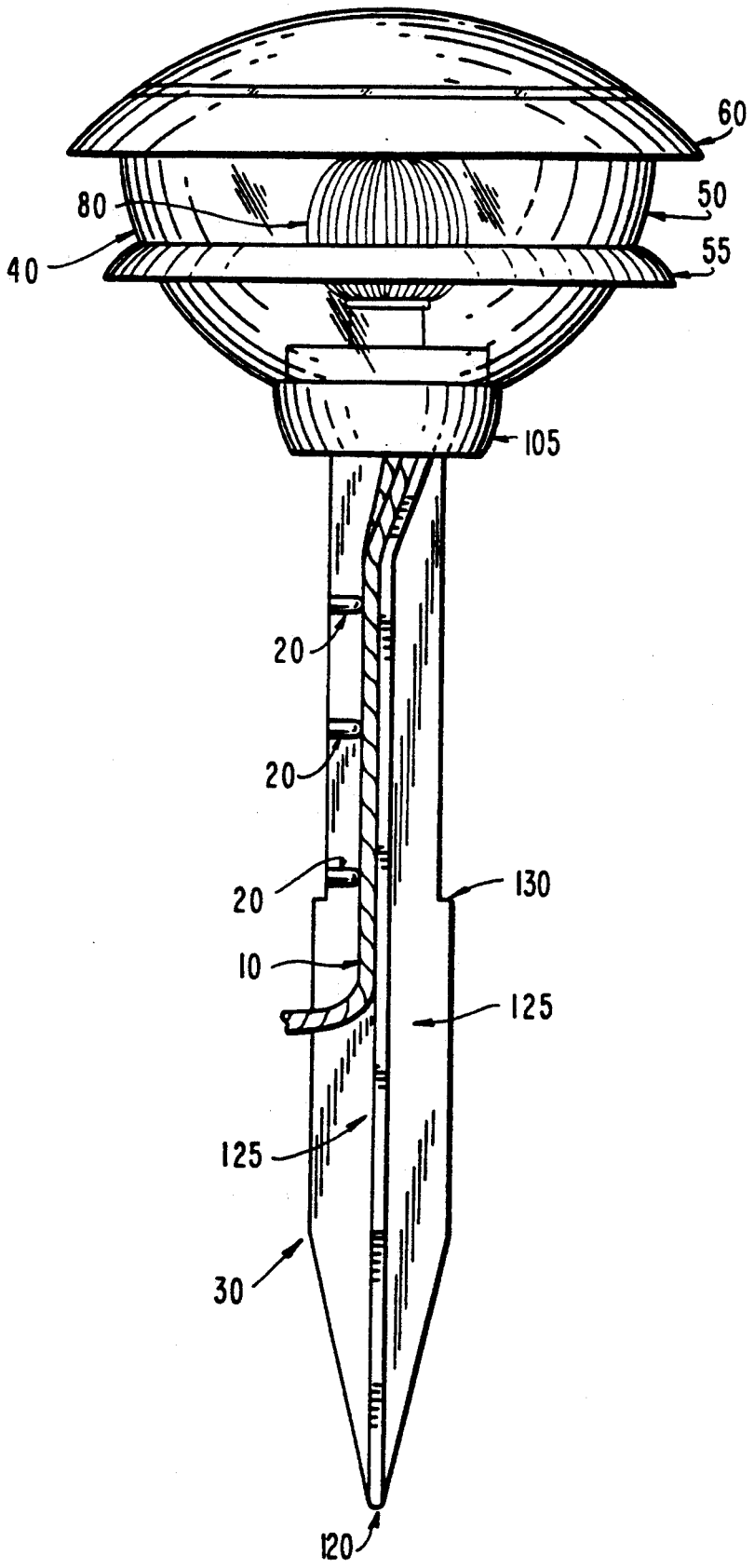
FIG. 1 is a front view of a light fixture according to the present invention.
Figure 2:
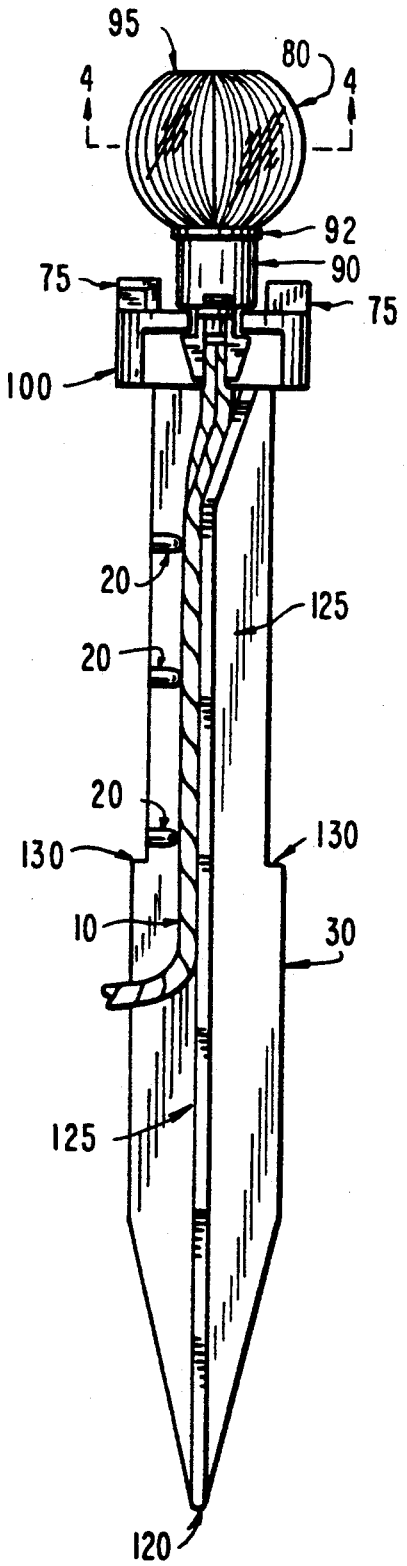
FIG. 2 is the light fixture of FIG. 1 with its cover removed.
Figure 3:
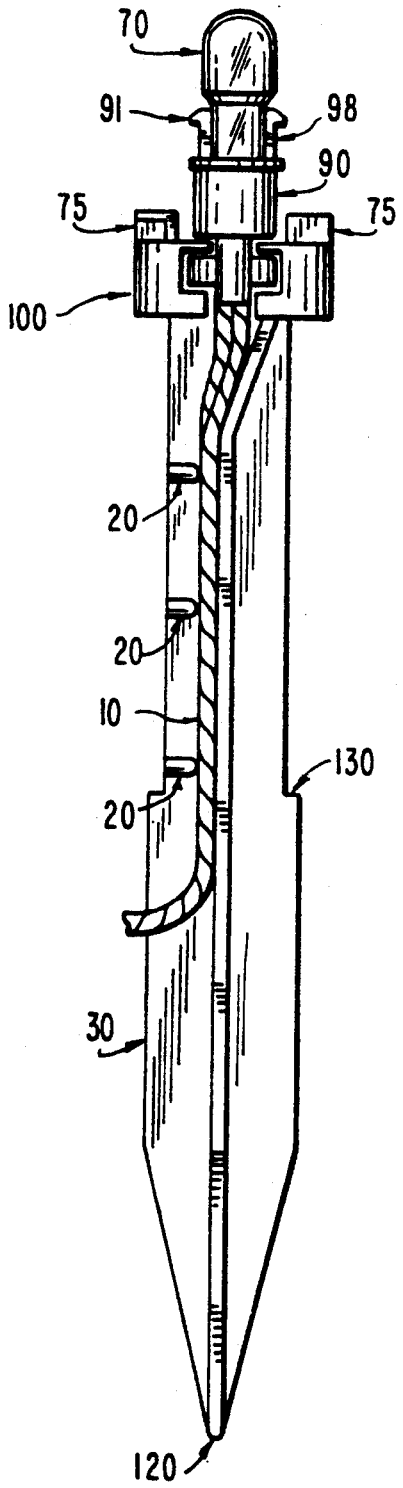
FIG. 3 is the light fixture of FIG. 2 with its inner refracting lens removed.

FIGS. 1–3 illustrate an outdoor light fixture according to the present invention. Electric current is provided by insulated wire 10. The wire preferably is retained in place by tabs 20 that protrude from stake 30. In an alternate embodiment, power is provided by solar panels that generate an electric current. In another embodiment, power is provided by batteries.

A globe assembly 40 is mounted to the light fixture. Any type of globe assembly 40 may be used which permits light to be emitted. Globe assembly 40 illustrated in FIG. 1 has, inter alia, a clear pane 50, a louver 55 and top 60. Various types of globe assemblies that may be used in alternate embodiments of the present invention are illustrated in co-pending, commonly-assigned U.S. design patent applications Ser. Nos. 07/696,521, 07/696,528 and 07/696,531, all filed on May 7, 1991. Preferably, a portion of the globe assembly 40 is clear in order to maximize the amount of light passing from the light bulb 70 through the globe. Having a clear or partially clear globe assembly 40 also provides a view of the interior of the globe for decorative purposes and to assist in installation and repair. The globe assembly 40 may be mounted to the light fixture using any structure that provides sufficient stability. Preferably, the mounting structure is adapted to conditions typical of outdoor use, such as heavy wind, rain or snow. Suitable mounting structures include hooks 75, tabs or snaps.

An inner refracting lens 80 is mounted to the light fixture. In the preferred embodiment depicted in FIGS. 1–2, the inner refracting 80 lens is mounted to bulb assembly 90 at the top of stake 30 such that it covers light bulb 70. In an alternate embodiment, the inner refracting lens 80 may be mounted to the stake or to a mounting assembly. Any means for mounting the inner refracting lens 80 may be used, such as hooks, tabs, threads or snaps 91.

The inner refracting lens 80 preferably has a generally spherical shape with flat ends, but other shapes also may be used. The ends preferably define openings 92, 95. The opening defined by the bottom end 92 is constructed such that the inner refracting lens 80 fits over the light bulb 70 and snaps into place using snap 91. Light bulb 70 thereby sits within the interior of the inner refracting lens 80. The light bulb 70 preferably does not protrude from the opening at the top end 95. The top end opening 95 provides thermal venting of heat generated by light bulb 70. Also in this preferred arrangement, the amount of light from the top of the light bulb 70 is maximized because there is no obstruction from the inner refracting lens 80, but it is reflected in a generally downward direction, thereby diminishing hot spots.

In use, the light bulb 70 is inserted into bulb receiving elements 98 and then the inner refracting lens 80 is fitted over the light bulb 70 through the bottom opening 92. In an alternate embodiment, the inner refracting lens 80 is mounted first and then the light bulb 70 is fitted through the top opening 95 of the inner refracting lens and inserted into bulb receiving elements 98.

The outer surface of inner refracting lens 80 preferably has ridges that are arranged such that they refract light emitted by the light bulb 70. Other arrangements for refracting light also may be used, such as dimples or polygon shaped ridges on a surface of the inner refracting lens 80. Frosting may be used to soften the light emitted.

Figure 4:
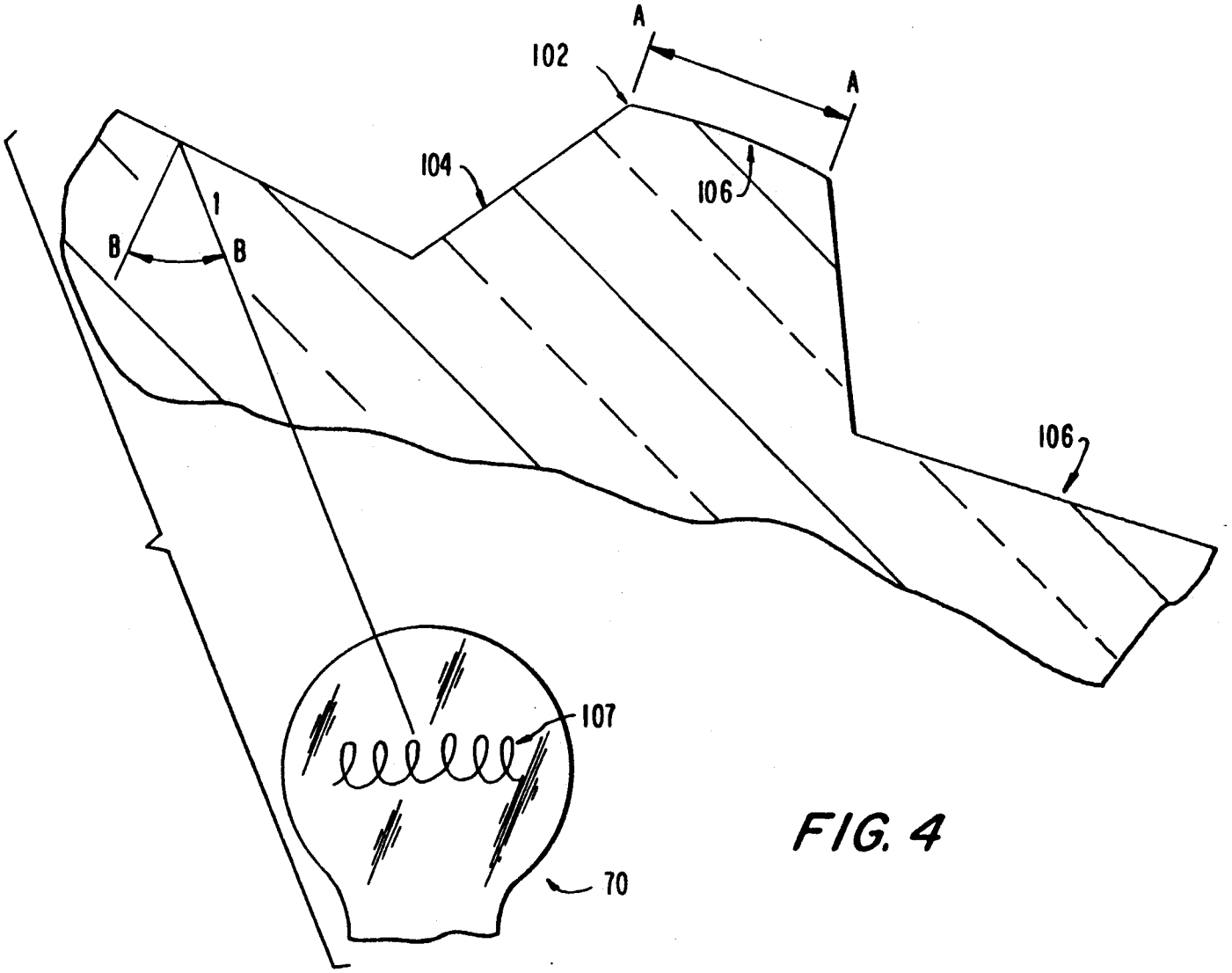
FIG. 4 is an enlargement of a partial cross-section of an inner refracting lens according to the present invention.

In the preferred embodiment, the ridges are arranged so as to maximize the amount of light being transmitted through the inner refracting lens 80. As depicted in FIG. 4, the ridges 102 preferably are separated by generally "V" shaped indentations 104 that are spaced apart from each other. Light passing through the arcuate top surface 106 of the ridge 102 generally is not refracted. In order reduce the apparent light source size and intensity as viewed outside the lens 80, the width of the top of each ridge (as measured by line A—A) is less than the length of the filament 107 of the light bulb 70, if a filament-type light source is used. The amount of unrefracted light transmitted may be reduced by decreasing the width of the ridges. Light transmitted through the angled indentations 104 is refracted. It is preferred that each of the angled indentations generally has the same interior angle, although, alternatively, varying angles may be used. If the angle of incidence (measured by angle B—B) is too high (i.e., above the "critical angle"), light will be reflected back to the interior of the lens rather than transmitted through the lens as desired. Therefore, in order to maximize the amount of light transmitted it is preferred that an angle of incidence be selected such that all light is transmitted. The critical angle varies for different materials, depending on the materials' light transmissibility characteristics. For the preferred clear plastic—a polycarbonate—the critical angle is about 40.1°.

The inner refracting lens 80 is mounted inside the globe assembly 40. Preferably, the bottom 105 of the globe assembly 40 defines an opening such that, in use, the globe may be slid over the mounted inner refracting lens 80 and secured to the light fixture using mounting means 75. In an alternate embodiment the top 60 of the globe assembly 40 may be removed and, in use, the globe assembly 40 is mounted to the light fixture and then the inner refracting lens 80 is inserted through the open top of the globe and over the light bulb 70, and then the top is attached.

The stake 30 may take any shape and be constructed of any material such that it can be inserted into the ground in a stable fashion and support the other components of the light fixture. It is preferred that the stake 30 be constructed of a material that resists decay and corrosion because the preferred use of the light fixtures of the present invention is outdoors. Preferably the stake 30 is constructed of a high impact, weather and ultraviolet light resistant polymer, but other materials, such as stainless steel or aluminum may be used.

The stake 30 preferably has a pointed tip 120 to ease insertion into the ground. The stake also preferably has an "X" shaped cross-section to provide strength and to provide convenient stake channels 125 for guiding the wire 10. Other cross-section patterns such as "U", circular, diamond or rectangular shapes may be used. Tabs 20 help to hold the wire 10 in place. In typical use, a portion of the stake is underground and the remainder is above-ground. The portion underground anchors the stake 30 in position. It is therefore important in use that a sufficient portion of the stake 30 be buried. Preferably, the stake 30 is constructed with markings such as indentations 130 indicating the portion of the stake, below the indentations 130, intended to be buried. In one embodiment, the tabs 20 are located on the portion of the stake 30 intended to be above-ground. A protective cover may be wrapped around the stake to protect the wire from the atmosphere, animals and yard machinery such as lawn mowers and weed cutters. Preferably, the protective cover shields the entire portion of the stake that is intended to be above-ground.

In the preferred embodiment, electricity is supplied through wire 10, which preferably is connected to a power supply. Multiple light fixtures may be connected to a single power supply. A single wire 10 may is used to provide power to each of the light fixtures as follows: the wire is run underground from the power supply to the first light fixture; the wire then is run up the stake 30 of the first light fixture, preferably in a stake channel 125; the wire is conductively connected to the light fixture using connector 100; the wire is run down the stake 30, preferably through another stake channel 125, until it is below ground; the wire then is run underground to the next light fixture and is connected as described above. These steps are repeated until each light fixture desired is connected.

Any apparatus may be used to connect the wire 10 to the light fixture such that a conductive contact is achieved. In the preferred embodiment, the angular displacement connector 100 described in above-identified and co-pending, commonly-assigned U.S. patent application Ser. No. 07/742,917 is used. Alternatively, crimped connectors or sliding connectors may be used.

Any source of electric power may be used, such as typical electric outlets in American and European homes. In the preferred embodiment, a low voltage power source is used. In this embodiment, wire 10 preferably is connected to a low voltage power supply. An acceptable low voltage power supply provides less than 40 volts AC through the wire and preferably generally provides 12 volts AC through the wire. In addition, a timing mechanism, such as an electronic timer or a photosensor may be incorporated which can be set to turn the light fixtures on and off at desired times or light levels.

Thus, it is seen that an outdoor light fixture with an inner refracting lens is provided. One skilled in the art will appreciate that the present invention can be practiced by other than the preferred embodiments which are presented for purposes of illustration and not of limitation, and the present invention is limited only by the claims which follow.

What is claimed is:

1. A light fixture comprising:

a support means for supporting the components of the light fixture;

a light source holding means mounted on the support means;

a light source means adapted to be held by the light source holding means;

an inner refracting lens that is mounted to the light fixture such that the light source means is situated in the interior of the inner refracting lens, said inner refracting lens comprising means for refracting light emitted from the light source means;

a globe assembly, said globe assembly being mounted to the light fixture such that is encloses the inner refracting lens; and wherein the globe assembly comprises an opaque top, said opaque top comprising a reflective inner surface.

2. The light fixture of claim 1 wherein the globe assembly comprises a bottom end that defines an opening that is large enough to allow the globe assembly to be fitted over the inner refracting lens through the opening in the bottom end of the globe assembly.

3. The light fixture of claim 1 wherein the globe assembly comprises at least one clear pane.

4. A light fixture comprising:

a support means for supporting the components of the light fixture;

a light source holding means mounted on the support means;

a light source means adapted to be held by the light source holding means;

an inner refracting lens that is mounted to the light fixture such that the light source means is situated in the interior of the inner refracting lens, said inner refracting lens comprising means for refracting light emitted from the light source means; wherein:

said inner refracting lens comprises an outer surface; and said means for refracting light comprises a plurality of ridges separated by a plurality of angled indentations; and wherein the angled indentations comprise an outer surface for which the angle of incidence is less than 40.1°.

5. The light fixture of claim 4 wherein the inner refracting lens is substantially clear and said ridges are constructed such that light emitted from the light source means is refracted as it passes through the inner refracting lens.

6. The light fixture of claim 5 wherein the inner refracting lens further comprises an outer surface, said ridges being on the outer surface.

7. The light fixture of claim 4 wherein the inner refracting lens comprises:

a bottom end by which the inner refracting lens is mounted to the light fixture; and a top end opposite to the bottom end; wherein the top and bottom ends define respective top and bottom openings.

8. The light fixture of claim 7 wherein the bottom opening is large enough to allow the inner refracting lens to be fitted over the light source means.

9. The light fixture of claim 4 wherein said support means comprises guide means for guiding and holding in place an insulated wire means.

10. The light fixture of claim 9 wherein said guide means comprises at least one stake channel means.

11. The light fixture of claim 9 wherein said guide means comprises at least one tab.

12. A light fixture comprising:

a support means for supporting the components of the light fixture;

a light source holding means mounted on the support means;

a light source means adapted to be held by the light source holding means;

an inner refracting lens that is mounted to the light fixture such that the light source means is situated in the interior of the inner refracting lens, said inner refracting lens comprising means for refracting light emitted from the light source means; wherein:

said inner refracting lens comprises an outer surface; and said means for refracting light comprises a plurality of ridges separated by a plurality of angled indentations;

said light source means comprises a filament; and each of said ridges comprises a substantially arcuate top surface;

wherein the width of each of said top surfaces is less than the length of said filament.

13. A lighting system comprising:

at least one low voltage power supply;

an insulated wire means conductively connected to the low voltage power supply; and a plurality of light fixtures conductively connected to said insulated wire means; wherein each of said light fixtures comprises:

a support means for supporting the components of the light fixture;

a light source holding means mounted on the support means;

a light source means adapted to be held by the light source holding means;

an inner refracting lens that is mounted to the light fixture such that the light source means is situated in the interior of the inner refracting lens, said inner refracting lens comprising means for refracting light emitted from the light source means, wherein said means for refracting light comprises:

a plurality of discrete ridges wherein each of the ridges comprises an outer surface for which the angle of incidence is less than 40.1°.

* * * * *